US008205568B2

(12) United States Patent
Braun

(10) Patent No.: US 8,205,568 B2
(45) Date of Patent: Jun. 26, 2012

(54) WORKBOAT FOR LIFTING AND TRANSPORTING WATERBORNE ITEMS

(76) Inventor: Jeffrey R. Braun, Lafayette, NJ (US)

( * ) Notice: Subject to any disclaimer, the term of this patent is extended or adjusted under 35 U.S.C. 154(b) by 154 days.

(21) Appl. No.: 12/603,965

(22) Filed: Oct. 22, 2009

(65) Prior Publication Data

US 2011/0094431 A1 Apr. 28, 2011

(51) Int. Cl.
*B63B 27/00* (2006.01)
*B63B 35/04* (2006.01)
*H02G 1/10* (2006.01)

(52) U.S. Cl. ..... 114/268; 254/134.3 SC

(58) Field of Classification Search ..... 114/268, 114/70, 72, 73, 366, 372; 414/138.1, 595, 414/598; 254/134.3 SC, 323, 329
See application file for complete search history.

(56) References Cited

U.S. PATENT DOCUMENTS

| | | | | |
|---|---|---|---|---|
| 575,272 | A | 1/1897 | Potter | |
| 659,489 | A | 10/1900 | Osgood | |
| 883,635 | A | 3/1908 | Francis | |
| 919,498 | A | 4/1909 | Turner | |
| 2,348,389 | A | 5/1944 | Johnson | |
| 2,640,284 | A | 6/1953 | Nielsen | |
| 2,667,649 | A * | 2/1954 | Elling | 114/372 |
| 2,761,571 | A * | 9/1956 | Adams | 414/137.7 |
| 2,853,812 | A | 9/1958 | Van Riet et al. | |
| 2,952,083 | A | 9/1960 | Forkner | |
| 3,390,657 | A * | 7/1968 | Schneider | 114/268 |
| 3,486,253 | A | 12/1969 | Bruggeman | |
| 3,993,011 | A * | 11/1976 | Garland | 414/137.7 |
| 4,034,695 | A * | 7/1977 | Kitai | 114/268 |
| 4,124,124 | A | 11/1978 | Rivet | |
| 4,150,635 | A * | 4/1979 | Lloyd et al. | 114/61.14 |
| 4,534,738 | A | 8/1985 | McKnight | |
| 4,592,155 | A | 6/1986 | Mustonen | |
| 4,676,052 | A | 6/1987 | Hawk | |
| 4,797,055 | A * | 1/1989 | Tworoger et al. | 414/283 |
| 4,831,751 | A | 5/1989 | Caddick | |
| 6,003,463 | A * | 12/1999 | Giesler | 114/259 |
| 6,273,767 | B1 | 8/2001 | Mustonen | |
| 6,918,801 | B2 | 7/2005 | Wilson, Jr. et al. | |
| 7,234,405 | B2 | 6/2007 | Hodgson | |
| 2002/0129755 | A1 * | 9/2002 | Hagen et al. | 114/268 |

* cited by examiner

*Primary Examiner* — Lars A Olson
*Assistant Examiner* — Anthony Wiest
(74) *Attorney, Agent, or Firm* — Amster, Rothstein & Ebenstein, LLP

(57) ABSTRACT

A workboat comprises a floatable body having a bow and a stern, a mast having at least two rails mounted at the bow, a carriage that is movable longitudinally along the rails of the mast, and at least two forks extending outwardly from the carriage for lifting items in the water.

14 Claims, 7 Drawing Sheets

WORKBOAT FOR LIFTING AND TRANSPORTING WATERBORNE ITEMS

FIELD OF THE INVENTION

The present invention relates to workboats, and more particularly, to a workboat for lifting, manipulating, and transporting waterborne items.

BACKGROUND OF THE INVENTION

Frequently it is necessary to lift items which are floating or anchored in the water. For example, in areas of the world where it is anticipated that water will freeze, floating items such as boat lifts, rafts, floating docks and the like are removed from the water as winter approaches in order to avoid damage from ice. Similarly, it may become necessary to maintain floating structures which are anchored to the bottom, such as buoys. Buoys are often located far from a shoreline and accessibly only by boat. In such a case, it is desirable to lift the buoy out of the water to perform maintenance operations, such as changing batteries, maintaining solar cells, painting markings and the like, thereby allowing the operator to remain in the boat while performing the maintenance operations. It would also be advantageous to be able to place the buoy on a stable platform which will make it easier to perform the maintenance operations.

There exist various machines for lifting and transporting heavy items, such as conventional land-based forklifts. Conventional forklifts may be effective in lifting items on land, but are not effective in moving waterborne items, such as floating docks, rafts, boats, boatlifts, buoys, and the like, unless such item is adjacent a dock or the shore. Then, the movement is typically limited to movement from adjacent a dock or the shore to a location on land, and the reverse. An example of such land-based lifting device is found in U.S. Patent Publication No. 2008-0095578 A1.

Cranes are another type of land based machines for lifting and transporting heavy items. However, cranes are not suitable for reaching waterborne items located a distance away from the shore or for transporting items over longer distances. Moreover, it may not be economical to employ a crane for lifting smaller items. Further, cranes typically require slings or other means to support the load being lifted, which may be difficult to attach to a number of structures.

There also exist various water-based or amphibious vessels which include implements for performing water related tasks, such as bulldozing, digging, dredging, and pushing other vessels. See, for example, U.S. Pat. Nos. 2,853,812, 6,273,767, 4,831,751, and 4,534,738. However, these water-based or amphibious vessels are not suitable for carefully lifting, manipulating, and transporting waterborne items.

Accordingly, there is a need for more easily and inexpensively lifting, manipulating, and transporting waterborne items.

SUMMARY OF THE INVENTION

According to one embodiment, a workboat comprises a floatable body having a bow and a stern, a mast having at least two rails mounted at the bow, a carriage that is movable longitudinally along the rails of the mast, and at least two forks extending outwardly from the carriage for lifting items in the water.

In at least one embodiment, a lower portion of the mast is extendable below the body of the workboat.

In at least one embodiment, the mast is pivotably mounted for rotation between a vertical position and a horizontal position.

In at least one embodiment, the mast is pivotable to a intermediate inclined position.

In at least one embodiment, the mast is movably mounted for translation along the direction of the length of the workboat.

In at least one embodiment, the mast is movable forwardly beyond the bow of the workboat.

In at least one embodiment, adjustable support arms are attached between the mast and the body.

In at least one embodiment, the support arms are at least one of foldable, collapsible, telescoping, and rotatable.

In at least one embodiment, extensions are placed over at least a portion of the forks.

In at least one embodiment, the body includes a platform that is substantially flat at least at a front portion adjacent the bow.

In at least one embodiment, the body includes two or more floats supporting the platform.

In at least one embodiment, the workboat includes a propulsion system including a motor is located at a position that is from amidships aft to the stern of the body.

In at least one embodiment, the workboat includes a steering system.

In at least one embodiment, ballast is disposed at the stern of the body to counterbalance the forklift.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION OF THE EXEMPLARY EMBODIMENTS

Figure 1:
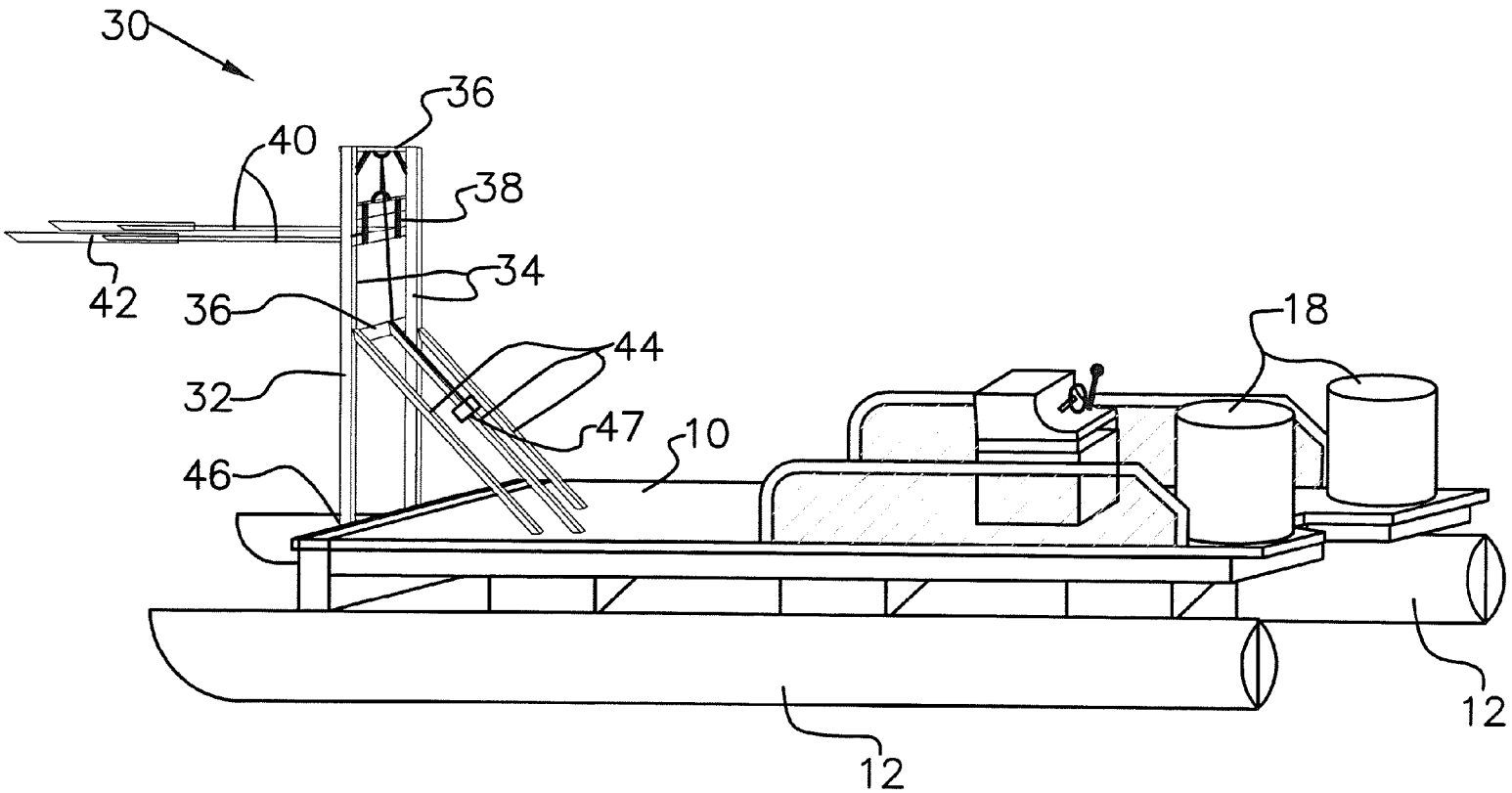
FIG. 1 is an perspective view of a workboat according to an exemplary embodiment.

FIGS. 1-4 illustrate an exemplary embodiment of a workboat for lifting, manipulating, transporting waterborne items, such as a floating dock, raft, boat, boatlift, buoy, and the like.

The workboat may be any one of the various types of boats, but is preferably a flat or shallow bottomed for working in shallower water. In an exemplary embodiment illustrated in the drawings, the workboat is a pontoon boat including a platform 10 connected to two or more floats 12. The platform 10 is substantially flat to provide a stable working deck at least at a portion of the workboat, for example, in the front portion of the workboat.

Figure 2:
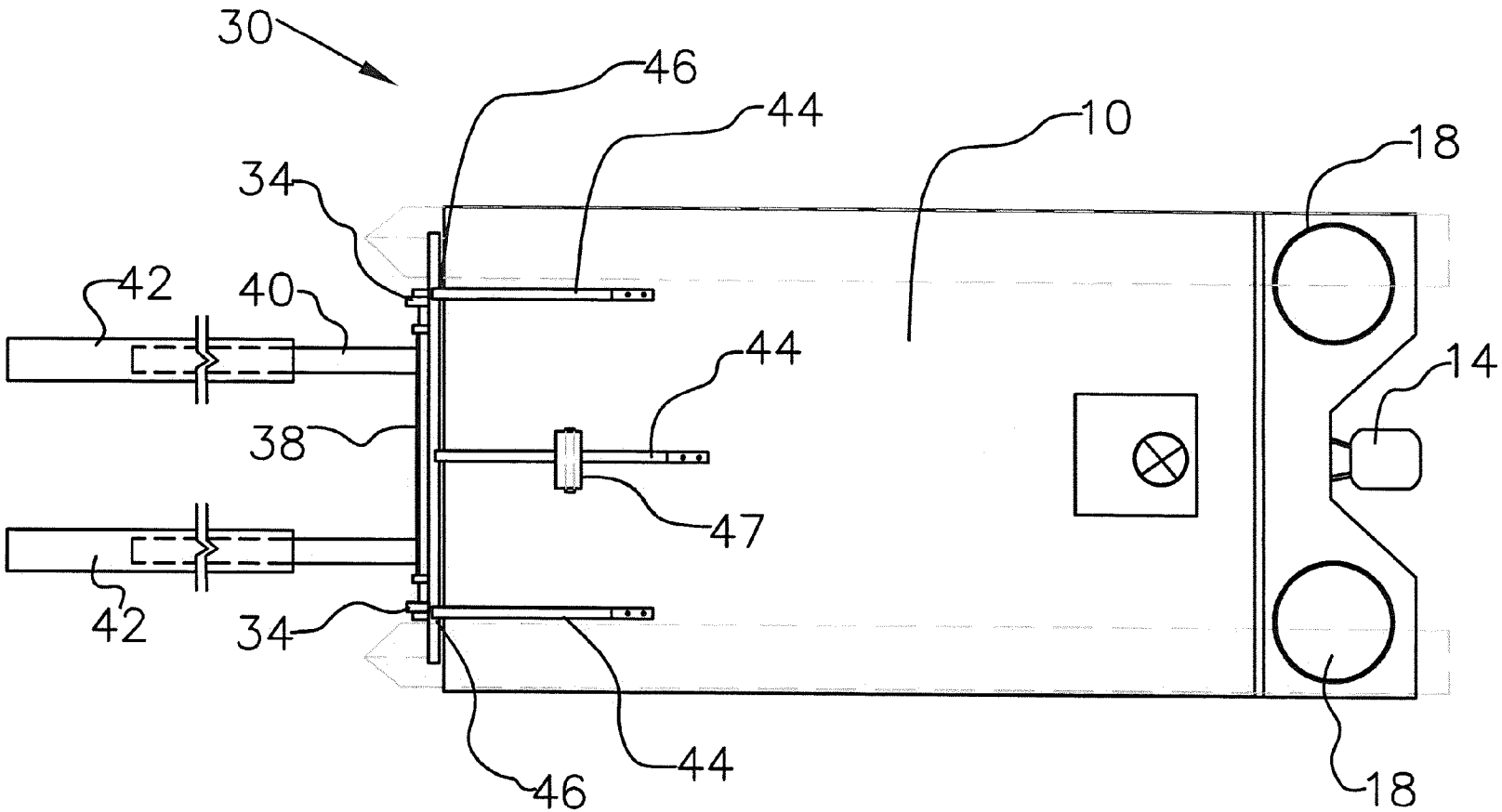
FIG. 2 is a top view of the workboat of FIG. 1.
Figure 3:
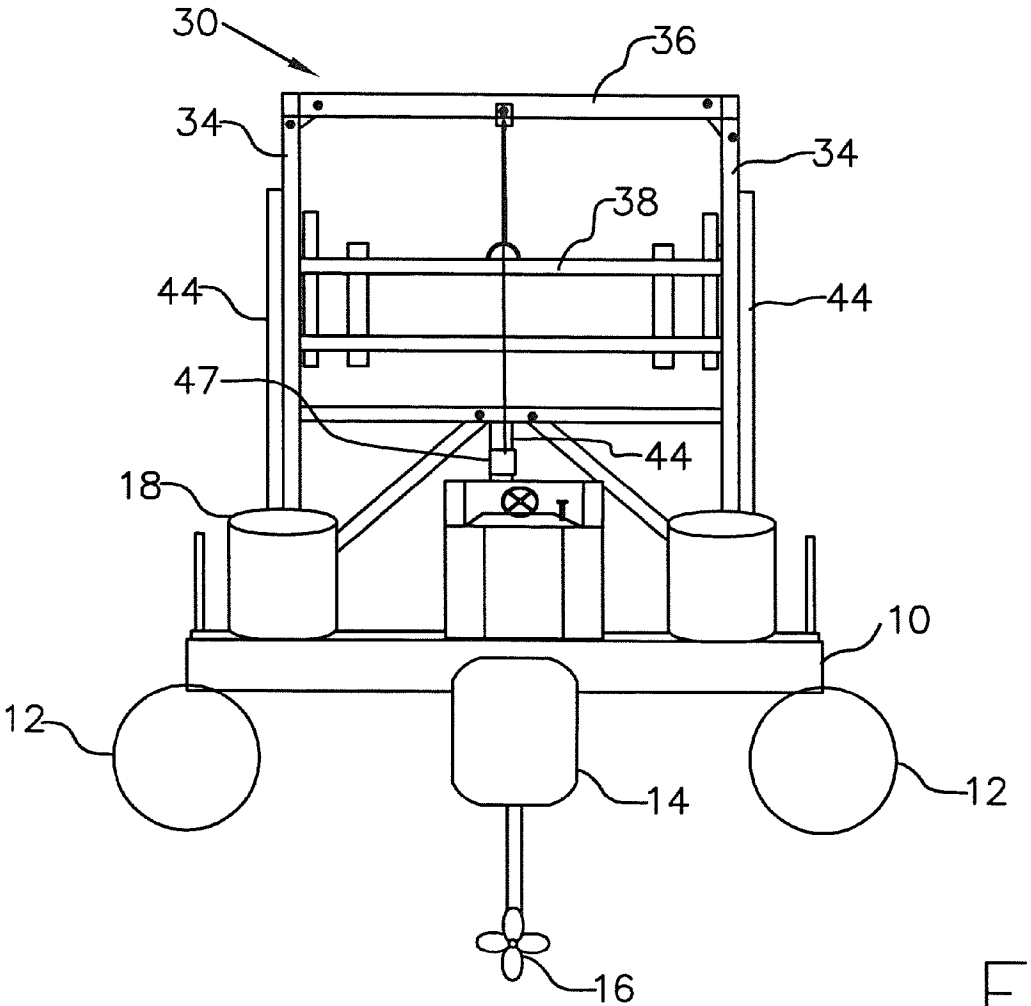
FIG. 3 is a rear view of the workboat of FIG. 1.
Figure 4:
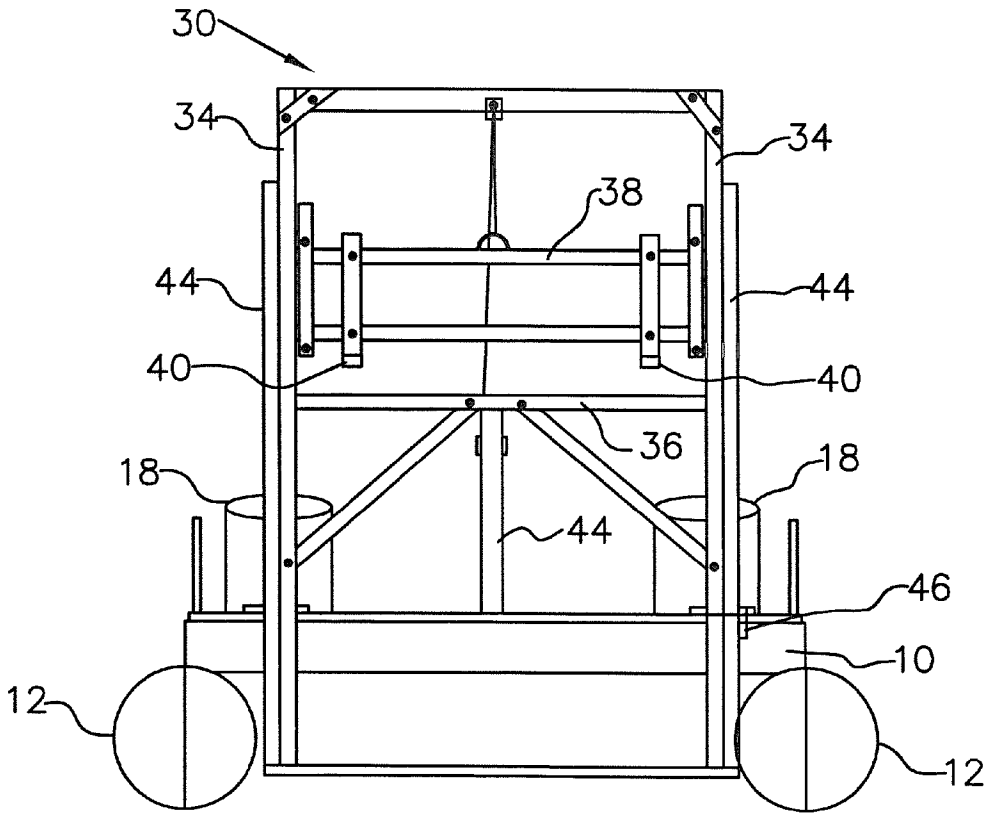
FIG. 4 is a front view of the workboat of FIG. 1.

The workboat includes a steering system and a propulsion system as shown in FIGS. 2 and 3. The propulsion system includes a propeller 16 driven by a motor 14. The motor 14 is preferably situated at a position from amidships aft to the stern, for example, in the back half of the workboat, to counterbalance a load that is to be lifted. The motor 14 may be an inboard, outboard, or inboard/outboard motor.

A forklift 30 is mounted at the bow of the workboat. The forklift 30 comprises a mast 32 having at least two vertical rails 34 mounted at the front of the platform 10, cross members 36 connecting the rails 34, a carriage 38 that moves up and down along the rails 34, and forks 40 extending outwardly from the carriage 38. The carriage 38 may be actuated hydraulically, electrically or manually.

Support arms 44 are attached to the forklift 30 to provide stability when the forklift 30 is in use. The support arms 44 are extended aft and attached to the platform 10 or to the sides of the workboat.

When the forklift 30 is in operation, the forks 40 are lowered to a position below the water to engage the underside of an item. The mast 32 may extend, or may be extendable, below the bottom of the workboat so that the forks 40 are able reach underneath items that sit lower in the water. Once the forks 40 are below the item, the forks 40 are lifted and the item suspended above the water. The item can then be transported to another location in the water or on land, placed on a dock, placed in a rack, or placed on another boat or barge.

Extensions 42 may be placed over the horizontal portion of the forks 40 to extend the fork length, when necessary, to extend the reach of the forks 40 to accommodate a longer item, such as a boat or a boatlift. The extensions 42 can also be specifically adapted for particular items. For example, if round buoys are to be lifted, the extensions 42 can be curved to better grip the buoys.

The workboat may be provided with ballast 18 to counterbalance the moment exerted on the forks 40 by the load. For example, the ballast 18 may be one or more drums mounted towards the stern of the boat and filled with water. Ballast may not be needed if the load is already sufficiently counterbalanced by the workboat, such as by having motor 14 placement at the stern or the workboat having a sufficient length.

Figure 5:
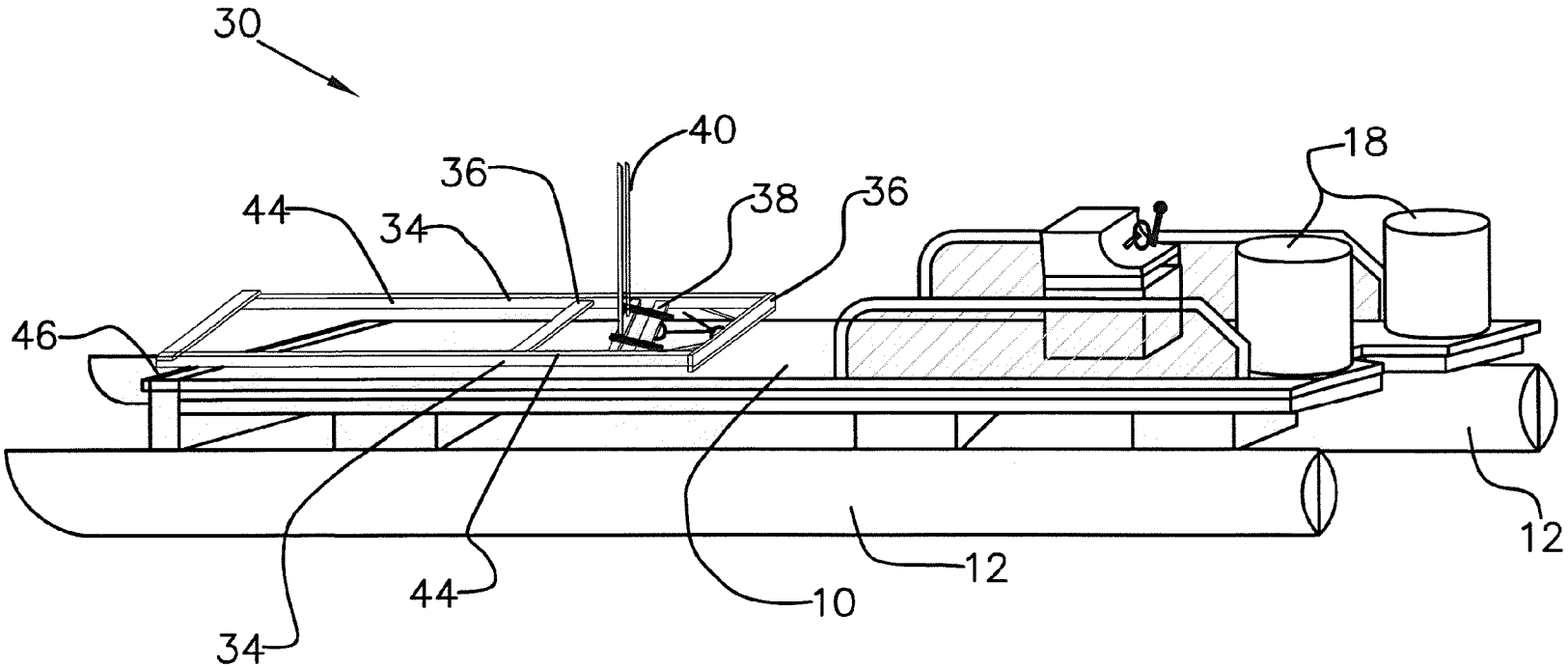
FIG. 5 is perspective view of a workboat according to an exemplary embodiment in which the forklift is rotated from a vertical working position to a horizontal transport position.
Figure 6:
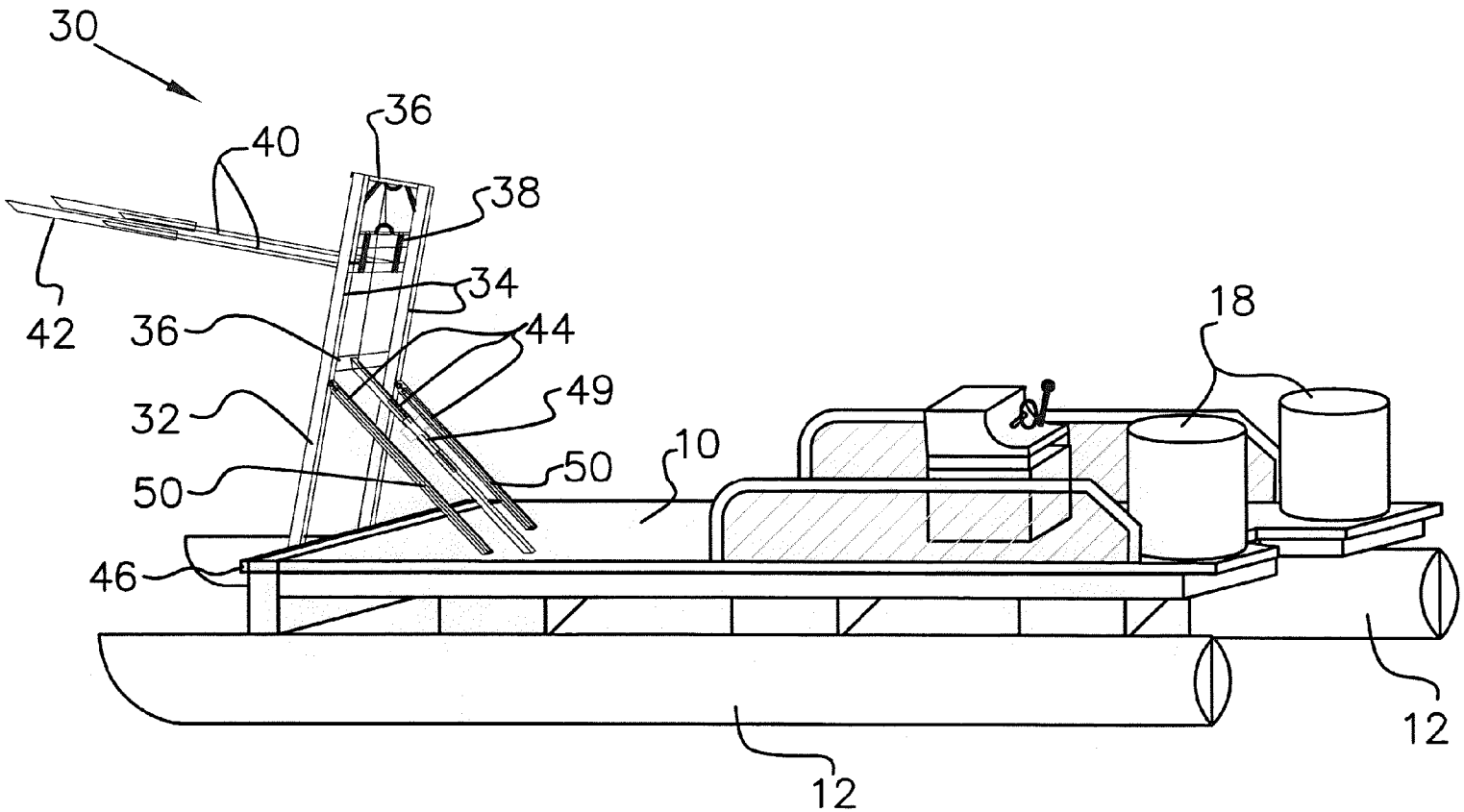
FIG. 6 is perspective view of a workboat according to an exemplary embodiment in which the forklift is rotated from an intermediate position.

It may be desirable to rotate the forklift 30 from a vertical working position to a horizontal transport position to allow for easier workboat maneuverability when the forklift 30 is not in use. In an embodiment as shown in FIG. 5, the mast 32 of the forklift 30 is pivotably mounted to the workboat at a pivot 46 for rotation from the vertical working position to the horizontal transport position. The support arms 44 may be adjustable or detachable so that they are not an impediment to the rotation of the mast 32. For example, the support arms 44 may be foldable, collapsible, telescoping, or rotatable. The mast 32 may also be pivoted to an intermediate inclined position as shown in FIG. 6. The mast 32 may be lockable in the inclined position to remain stationary during lifting of an item, however the mast 32 may also be rotatable rearwardly as the item is being lifted, for example, by the use of rams 49, 50. By angling the mast 32 towards the stern of the workboat, the center of gravity of the item moves rearwardly as the item is lifted. Depending on the height of the rails 34, the item may be raised out of the water and onto the workboat. The rotation of the mast 32 and/or movement of the support arms 44 may be actuated hydraulically, electrically, or manually.

Figure 7:
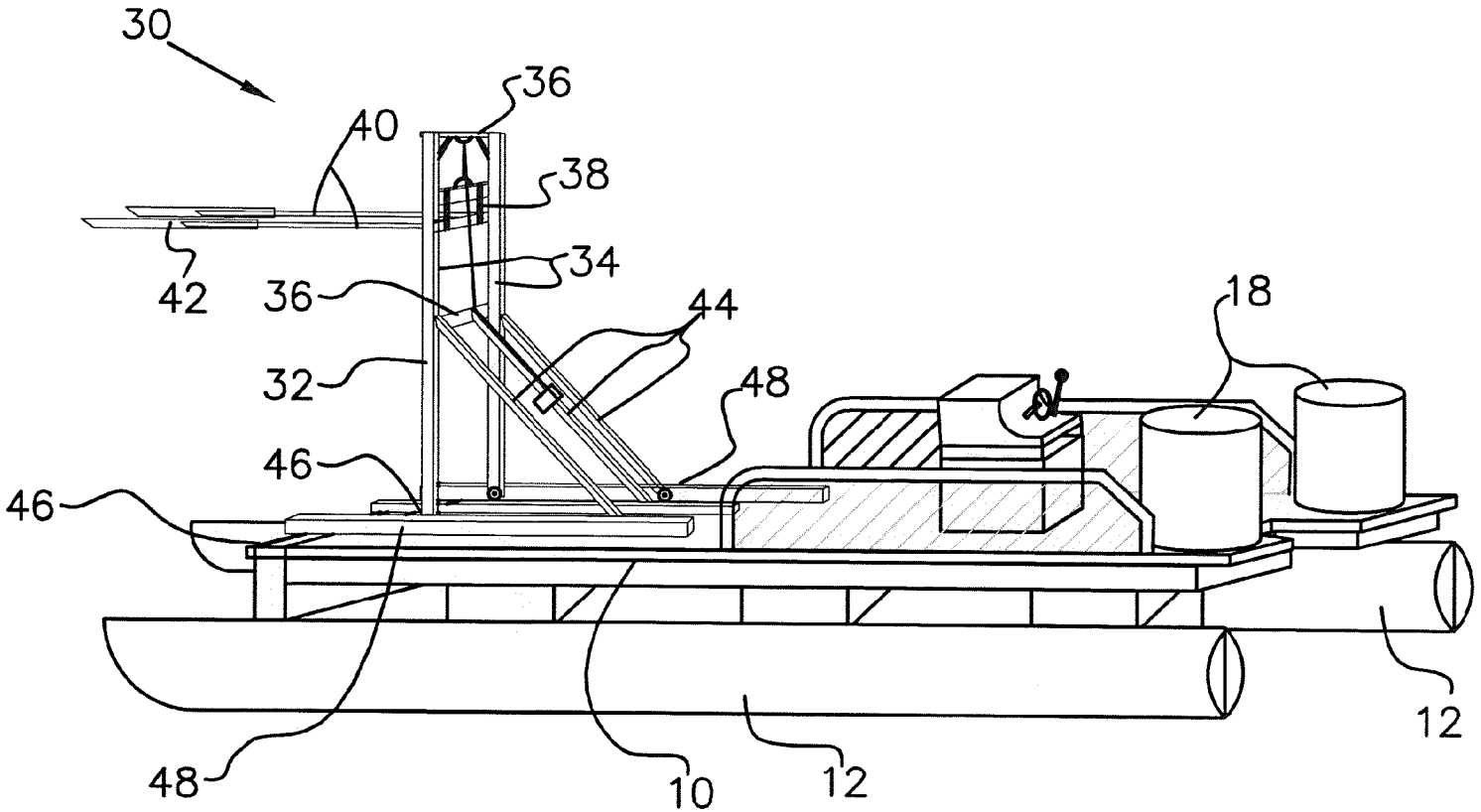
FIG. 7 is perspective view of a workboat according to an exemplary embodiment in which the forklift movable along the direction of the length of the workboat.

Further, it may be desirable to translate the forklift 30 along the direction of the length of the workboat. In an embodiment as shown in FIG. 7, the mast 32 and support arms 44 may be slidably mounted on tracks 48. For example, the mast 32 and support arms 44 may be attached to wheels or a carriage that is slidable along the tracks 48. The translation of the mast 32 and support arms 44 along the tracks 48 may be actuated hydraulically, electrically, or manually. In another embodiment, the tracks 48 may be extendable and contractible so as to translate the mast 32 and support arms 44 from the bow along the direction of the length of the workboat. The tracks 48 may be actuated hydraulically, electrically, or manually. Various other mechanisms for translating the forklift 30 may also be used.

Movement of the forklift 30 from the bow towards the stern increases stability of the workboat when the object is lifted out of the water, which is useful when transporting an object to the shore or to a different location. This feature also allows the item to be lifted completely out the water and onto the body of the workboat during transport. The tracks 48 may also be extended forwardly to allow the mast 32 to be extended beyond the bow of the workboat. This may allow for greater maneuverability of the forklift 30 when attempting to position the forks 40 to lift an item.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A workboat comprising:

a floatable body having a bow and a stern, comprising a substantially flat unitary platform, the platform extending from the bow to the stern;

a pair of tracks mounted on the platform extending from the bow in a direction towards the stern; and a forklift mounted on the platform at the bow of the workboat further comprising:

a mast having at least two rails, wherein each of the rails is slidably engaged with one of the pair of tracks at one end;

a carriage that is movable longitudinally along the rails of the mast; and at least two forks extending outwardly from the carriage for lifting items in the water; and a pair of adjustable support arms, wherein each support arm is slidably engaged with one of the pair tracks at one end and is connected to one of the rails at a location remote from where the rail is engaged with the track.

2. The workboat of claim 1, wherein a lower portion of the mast is extendable below the body of the workboat.

3. The workboat of claim 1, wherein the mast is pivotably mounted for rotation between a vertical position and a horizontal position.

4. The workboat of claim 3, wherein the mast is pivotable to a intermediate inclined position.

5. The workboat of claim 1, wherein the mast is movably mounted for translation along the direction of the length of the workboat.

6. The workboat of claim 5, wherein the mast is movable forwardly beyond the bow of the workboat.

7. The workboat of claim 1, wherein the support arms are at least one of foldable, collapsible, telescoping, and rotatable.

8. The workboat of claim 1, further comprising extensions placed over at least a portion of the forks.

9. The workboat of claim 1, wherein the body includes two or more floats supporting the platform.

10. The workboat of claim 1, further comprising a propulsion system including a motor located at a position that is from amidships aft to the stern of the body.

11. The workboat of claim 1, further comprising a steering system.

12. The workboat of claim 1, further comprising ballast disposed at the stern of the body to counterbalance the fork-lift.

13. A workboat comprising:

a floatable body having a bow and a stern, the body including a platform that is substantially flat at least at a front portion adjacent the bow and two or more floats supporting the platform;

a mast having at least two rails and at least one cross member connecting the rails, the mast being pivotably mounted at the bow for rotation between a vertical position and a horizontal position;

a carriage that is movable longitudinally along the rails of the mast;

at least two forks extending outwardly from the carriage for lifting items in the water;

at least one adjustable support arm attached between the body and at least one of the rails and cross member; and a pair of tracks for receiving the mast, the tracks connected to the platform, wherein the mast is moveable fore and aft within the tracks.

14. The workboat of claim 1, wherein the rails and the supporting arms are engaged with the tracks via plurality of wheels.

* * * * *